US007503808B1

(12) United States Patent
O'Shea

(10) Patent No.: US 7,503,808 B1
(45) Date of Patent: Mar. 17, 2009

(54) CONNECTOR DEVICE FOR COMPUTERS

(75) Inventor: James E. O'Shea, Hoffman Estates, IL (US)

(73) Assignee: Olympic Controls Corp., Elgin, IL (US)

( * ) Notice: Subject to any disclaimer, the term of this patent is extended or adjusted under 35 U.S.C. 154(b) by 0 days.

(21) Appl. No.: 11/837,923

(22) Filed: Aug. 29, 2007

(51) Int. Cl.
*H01R 25/00* (2006.01)

(52) U.S. Cl. ..... 439/639

(58) Field of Classification Search ..... 439/638, 439/639, 654; 361/686; 710/303, 304
See application file for complete search history.

(56) References Cited

U.S. PATENT DOCUMENTS

| | | | | |
|---|---|---|---|---|
| 5,186,646 | A | 2/1993 | Pederson | |
| D349,230 | S | 8/1994 | Essick | |
| D365,340 | S | 12/1995 | Hill et al. | |
| D371,769 | S | 7/1996 | Shima et al. | |
| D381,360 | S | 7/1997 | Kawai et al. | |
| 5,645,434 | A | 7/1997 | Leung | |
| 5,779,499 | A | 7/1998 | Sette et al. | |
| D414,165 | S | 9/1999 | Klein | |
| D421,424 | S | 3/2000 | Lee et al. | |
| 6,167,183 | A | 12/2000 | Swain | |
| 6,321,340 | B1 | 11/2001 | Shin et al. | |
| 6,607,408 | B2 | 8/2003 | Milan | |
| 6,612,873 | B2 | 9/2003 | Reid et al. | |
| 6,697,252 | B2 * | 2/2004 | Maeda | 361/686 |
| 6,722,917 | B2 | 4/2004 | Huang | |
| D494,934 | S | 8/2004 | Milan | |
| D495,336 | S | 8/2004 | Andre et al. | |
| D500,497 | S | 1/2005 | Yu et al. | |
| 7,247,032 | B2 | 7/2007 | Merz | |
| 2002/0168901 | A1 | 11/2002 | Choumach | |
| 2003/0148663 | A1 | 8/2003 | Hsin | |
| 2003/0216069 | A1 | 11/2003 | Huang | |
| 2004/0246644 | A1 | 12/2004 | Sato et al. | |
| 2006/0061964 | A1 * | 3/2006 | Cheng | 361/687 |
| 2007/0035917 | A1 | 2/2007 | Hotelling et al. | |

OTHER PUBLICATIONS

BookEndz, Docking Stations For Apple Laptops, 2005, 2 pages.

BookEndz, Flyer for MacBook Pro 17" Docking Station, available before Aug. 12, 2006, 1 page.

BookEndz, Flyer for MacBook Pro 15" w/Firewire 800 Docking Station, available before Aug. 12, 2006, 1 page.

BookEndz, MacBook Pro 15" Docking Station, available before Aug. 12, 2006, 1 page.

BookEndz, Website pages pertaining to BookEndz Docking Station for 17" MacBook Pro, available before Aug. 12, 2006, 7 pages.

(Continued)

*Primary Examiner*—Ross N Gushi
(74) *Attorney, Agent, or Firm*—Edward Bishop

(57) ABSTRACT

A connector device is provided for coupling to connectors associated with a laptop computer. The connector device includes a generally L-shaped housing having a pair of side walls, a rear wall, and a pair of front walls wherein one of the front walls is recessed from the other front wall. The recessed front wall includes a plurality of input connectors for coupling to the connectors provided by the laptop computer. Further, at least one of the side walls includes a plurality of output connectors for transmitting and receiving electrical signals with the laptop computer.

9 Claims, 7 Drawing Sheets

OTHER PUBLICATIONS

BookEndz, Website pages pertaining to BookEndz Docking Station for 15" MacBook Pro—Firewire 800, available before Aug. 12, 2006, 8 pages.

BookEndz, Website pages pertaining to BookEndz Docking Station for 15" MacBook Pro, available before Aug. 12, 2006, 9 pages.

BookEndz, Website pages pertaining to BookEndz Dock for the 17" PowerBook G4, available before Aug. 12, 2006, 7 pages.

BookEndz, Website pages pertaining to BookEndz Dock for the 15" PowerBook G4, available before Aug. 12, 2006, 6 pages.

BookEndz, Website pages pertaining to BookEndz Dock for the 12" PowerBook G4—DVI, available before Aug. 12, 2006, 4 pages.

BookEndz, Website pages pertaining to BookEndz Dock for the 12" PowerBook G4, available before Aug. 12, 2006, 4 pages.

BookEndz, Website pages pertaining to BookEndz Dock for the 2002 PowerBook G4, available before Aug. 12, 2006, 3 pages.

* cited by examiner

CONNECTOR DEVICE FOR COMPUTERS

CROSS-REFERENCE TO RELATED APPLICATIONS

None.

TECHNICAL FIELD

The present invention is directed to a connector device, and more specifically to a connector device for allowing a computer, such as a portable computer, to easily and quickly be connected to a plurality of peripheral devices.

BACKGROUND OF THE INVENTION

Currently, "docking stations" are used for connecting a notebook or portable computer to a variety of external peripherals. Typically, docking stations are electrical devices that run off AC or DC power and mate with an electrical connector specifically designed to interface with a particular series or model of notebook or portable computer. Docking stations were created to add functionality to the notebook computer by providing space and power for other electric or peripheral attachments which the notebook computer does not have, due to its size or power limitations.

An alternative to the docking station is disclosed in U.S. Pat. No. 5,186,646 to Pederson. Disclosed therein is a connector device for positioning a plurality of peripheral connectors in relative positions for registration with a plurality of corresponding computer ports. The connector device has a body having a plurality of peripheral connector holding means for securely holding and positioning a plurality of peripheral connectors, each peripheral connector holding means being located in the body so as to position a peripheral connector held therein in a registering position with respect to a predetermined port of the computer, whereby the computer ports register for direct attachment and detachment to a plurality of peripheral connectors.

SUMMARY OF THE INVENTION

In an embodiment in accordance with the present invention, a connector device is provided that attaches to a plurality of connectors associated with a portable or laptop computer. The connector device includes a generally L-shaped block or housing having a pair of side walls, a rear wall, and a front comprising a pair of walls wherein one of the walls is setback from the other wall. The setback front wall includes a plurality of input connectors for coupling to the connectors provided by the portable computer. Further, at least one of the side walls includes a plurality of output connectors for transmitting and receiving electrical signals between the portable computer and a plurality of external peripheral devices, via the connector device.

In a further embodiment in accordance with the present invention, a connector device is provided having a generally L-shaped block or housing with a plurality of input ports. Moreover, the housing provides a plurality of output ports wherein, on the housing, there are a greater number of output ports than input ports.

In yet another embodiment in accordance with the present invention, a connector device provides for coupling to connectors associated with a portable or laptop computer. The connector device includes a generally L-shaped block or housing having a pair of side walls, a rear wall, a pair of front walls, and a bottom. One of the front walls is setback from the other front wall and has a notch formed therein. A channel is formed in the bottom of the housing and extends from the rear wall to the notch in the setback wall. Also, the setback front wall includes a plurality of input connectors for coupling to the connectors provided by the portable or laptop computer. In addition, at least one of the side walls includes a plurality of output connectors for transmitting and receiving electrical signals with the portable or laptop computer. Further, the connector device includes more output ports than input ports.

Other embodiments, systems, methods, features, and advantages of the present invention will be, or will become, apparent to one having ordinary skill in the art upon examination of the following drawings and detailed description. It is intended that all such additional systems, methods, features, and advantages included within this description be within the scope of the present invention, and can be protected by the accompanying claims.

BRIEF DESCRIPTION OF THE DRAWINGS

The invention may be better understood with reference to the following drawings. The components in the drawings are not necessarily to scale, emphasis instead being placed upon illustrating the principles of the invention. In the drawings, like reference numbers designate corresponding parts throughout.

DETAILED DESCRIPTION

The following descriptions of detailed embodiments are for exemplifying the principles and advantages of the inventions claimed herein. They are not to be taken in any way as limitations on the scope of the inventions.

Figure 1:
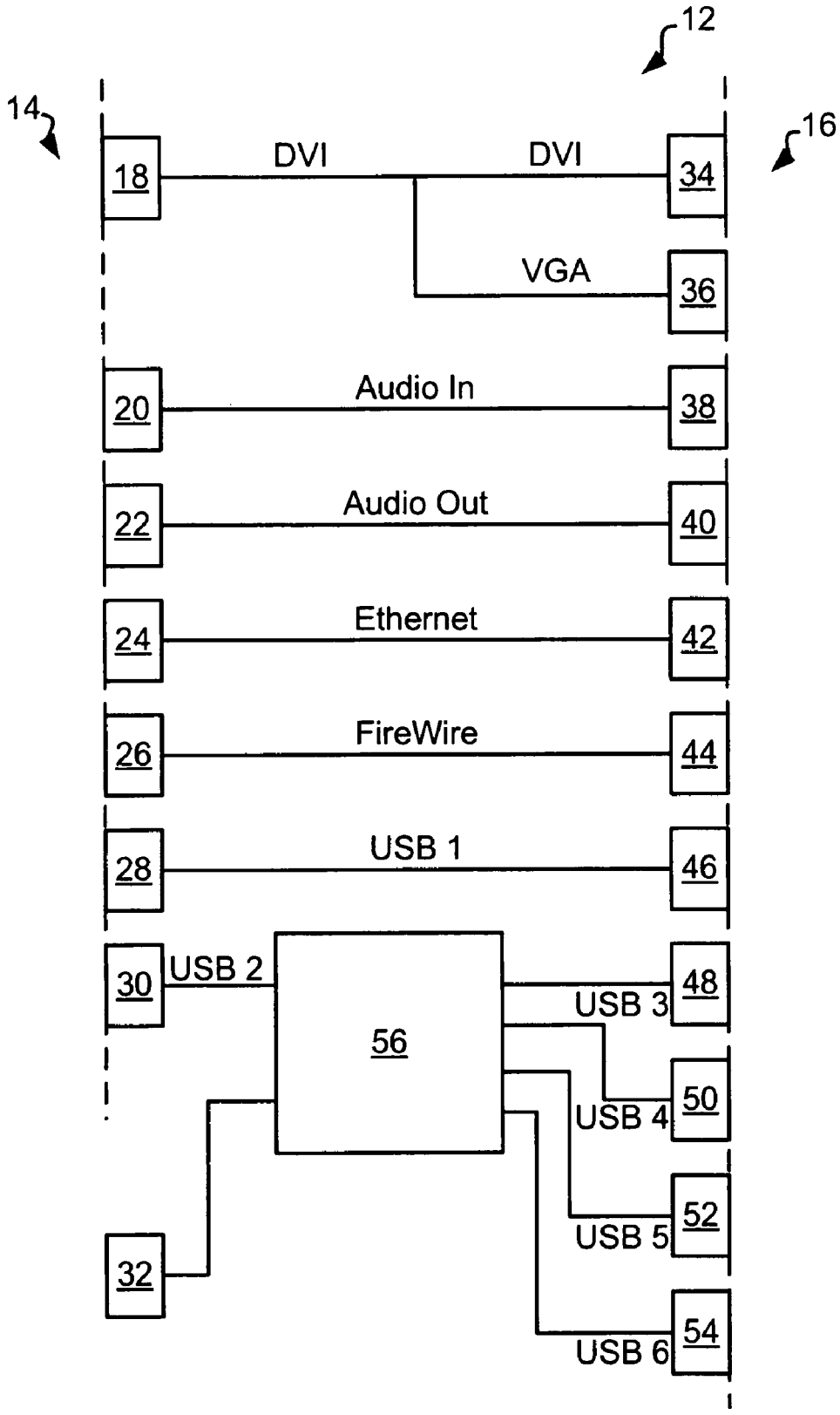
FIG. 1 is a simplified function block diagram of a connector device in accordance with the present invention.

In one application of an embodiment in accordance with the present invention, a connector device is provided having a plurality of input ports and output ports. Turning to FIG. 1, a simplified block diagram is provided of a connector device in accordance with the present invention.

The connector device 12 includes a plurality of input ports 14 and a plurality of output ports 16. In an embodiment, there are eight (8) input ports 14 comprising a mini-DVI (i.e., Digital Visual Interface) port 18, an audio input port 20, an audio output port 22, an Ethernet port 24, a FireWire port 26, two USB (i.e., Universal Serial Bus) ports 28 and 30, and a USB power port 32. Further, the connector device 12 includes eleven (11) output ports 16 comprising a full size DVI port 34, a full size VGA monitor port 36, an audio input port 38, an audio output port 40, an Ethernet port 42, a FireWire port 44, and four USB ports 46, 48, 50, 52 and 54.

Input ports 18-30 are preferably compatible with like ports provided by a portable or laptop computer and thus directly connect or dock with the ports on the portable computer. In an embodiment, but not necessarily, the portable computer is a 13" DVI MacBook by Apple Inc., Cupertino, Calif.

Accordingly, input ports 18-30 are spaced apart from each other by the same distance as the like ports provided by the portable or laptop computer. Moreover, the input ports 18-30 provide a receptacle or plug for properly connecting or mating with the like ports provided by the portable computer. As such, it should be understood that the invention could be used in connection with any portable or laptop computer by providing properly located connectors, on the housing of the connector device, of the proper shape or type that correspond with those of various other computers and their ports.

In an embodiment, input port 18 is a conventional Mini-DVI plug that is received by a conventional socket or receptacle on the portable computer. As shown in FIG. 1, the Mini-DVI input port 18 is electrically coupled to output port 34 comprising a conventional full size DVI female connector. Thus, electrical signals, and in particular DVI signals, can be passed between port 18 and port 34.

As will be appreciated by those having ordinary skill in the art, Mini-DVI connectors are used on Apple computers as a digital alternative to Mini-VGA connectors. Accordingly, in an embodiment, the Mini-DVI connector plug 18 satisfies the requirements of Apple, Inc. Likewise, in an embodiment, the full size DVI plug is a conventional DVI digital and analog connector.

Also electrically coupled to input port 18 is output port 36 comprising a full size VGA connector. As such, electrical signals, and in particular VGA signals, can be passed between port 18 and port 36. As will be appreciated by those having ordinary skill in the art, such VGA connectors 36 are commonly known by other names such as RGB connector, D-sub 15, mini sub D15 and mini D15, and satisfies the requirements of the designer, IBM.

Turning to the audio ports, audio port 20 is electrically coupled to port 38 and, likewise, audio port 22 is electrically coupled to port 40. Preferably, but not necessarily, ports 20 and 38 are conventional audio plugs and ports 22 and 40 are conventional audio jacks or sockets.

The audio ports 20 and 38 provide for transferring electrical audio input signals from port 38 to port 20. In an embodiment, but not necessarily, these audio input signals can be received by various electrical devices connected to port 38 such as portable media players.

Similarly, audio ports 22 and 40 provide for transferring electrical audio output signals from port 22 to port 40. In an embodiment, but not necessarily, these audio input signals can be received by various external electrical devices connected to port 40 such as a pair of speakers.

Preferably, plug connector 22 is selectively connectable to the computer. This feature allows the user to determine whether to use speakers that are either internal or external to the portable computer. As explained in detail further herein, a lever is provided to selectively move the connector 22 in and out of engagement with the socket provided by the laptop computer.

In an embodiment, when the connector 22 is disengaged from the audio output connector provided by the laptop, then the speakers internal to the laptop are used for generating sound. Conversely, when the connector 22 engages the socket provided by the laptop, the laptop disables its speakers and the speaker signals are provided at output port 40 via the input port 22 connected to the computer. Accordingly, the electrical signals can be provided to external speakers via output connector 40.

Turning to the Ethernet ports 24 and 42, these ports are electrically coupled together in a conventional manner to provide an Ethernet transmission path therebetween. In an embodiment, input port 24 is a conventional RJ 45 or 8P8C plug and output port 42 is a conventional RJ45 or 8P8C socket.

Likewise, FireWire ports 26 and 44 are electrically coupled together in a conventional manner to provide a FireWire transmission path therebetween. In an embodiment, input port 26 is a conventional 6-pin FireWire plug and output port 44 is a conventional 6-pin FireWire socket.

Turning to the USB ports, USB port 28 is electrically coupled in a conventional manner to USB port 46 to provide a USB transmission path between the ports. In an embodiment, but not necessarily, input port 28 is a USB Type-A plug and output port 46 is a USB Type-A socket.

USB port 48, comprising a USB Type-A plug, is electrically coupled to a USB hub 56 along with USB ports 48-54 comprising conventional USB Type-A sockets. The USB hub 48 is a conventional device that allows many USB devices to connect to port 48 via ports 48-54. Preferably, but not necessary, hub 56 is powered by a conventional external five (5) volt power supply (not shown) that can be coupled and uncoupled to port 32 comprising a conventional two conductor socket.

Figure 2:
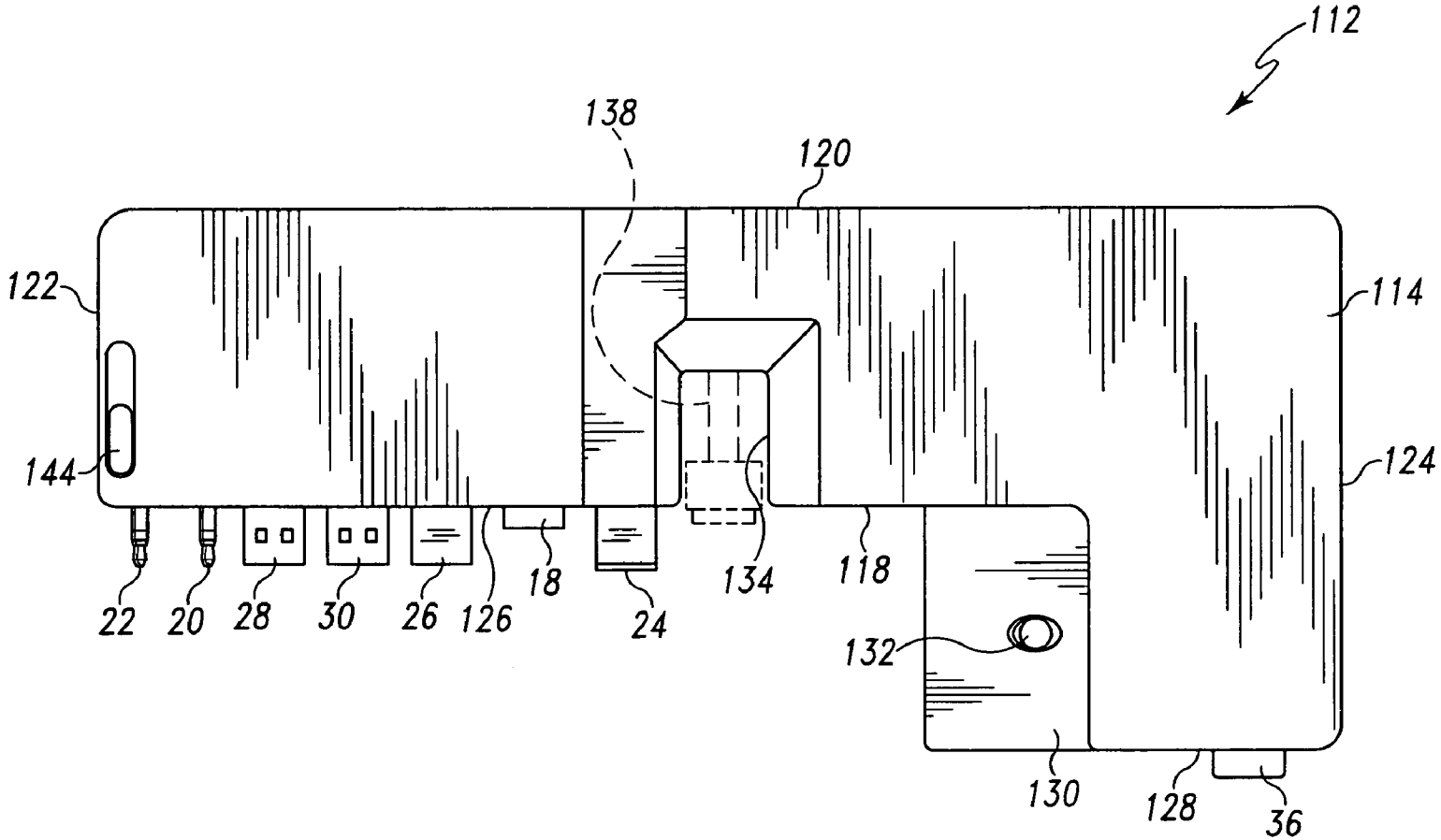
FIG. 2 is a plan view of an embodiment of a connector device in accordance with the present invention wherein the connector device includes the functionality depicted in FIG. 1.

Turning to FIG. 2, a plan view is provided of an embodiment of a connector device in accordance with the present invention. Preferably, but not necessarily, the connector device 112 provides the functionality depicted in the block diagram of FIG. 1.

The connector device 112 includes a generally L-shaped outer housing 114 constructed of plastic. Contained within the housing 114 is the USB hub 56 (FIG. 1) and conventional wiring for connecting the ports together as previously described above.

The housing 114 has a generally planar bottom wall or surface 116 (FIG. 3), a front 118, a generally planar rear wall or surface 120, and a pair of generally planar side walls or surfaces 122 and 124.

The front 118 of the housing 114 has a pair of front walls 126 and 128. In particular, the front 18 is stepped to provide a generally planar base portion or setback 126 that is parallel to a planar forward portion 128. An inclined wall 130 perpendicularly extends between the base and forward portions of the front wall.

In the inclined wall 130, a recessed light 132 is mounted. The light 132 is a conventional green light emitting diode operatively coupled to input port 32 for providing an indication of whether power is being received at port 32 from an external power source such as a transformer.

Perpendicularly extending from the base or setback portion 126 of the front 118 are the connectors for ports 18-30 as previously discuss with regard to FIG. 1. Also, the base wall 126 of the front 118 includes a notch 134 formed therein to provide access to a connector on a laptop computer 140 (FIG. 7) when the connector device 112 is attached to the laptop.

Figure 3:
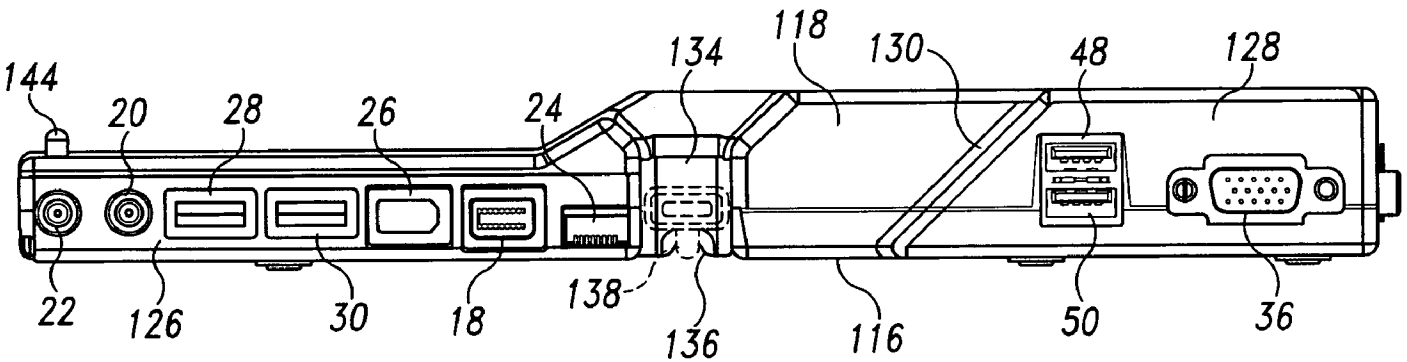
FIG. 3 is an elevation view of the front of the connector device depicted in FIG. 2.
Figure 4:
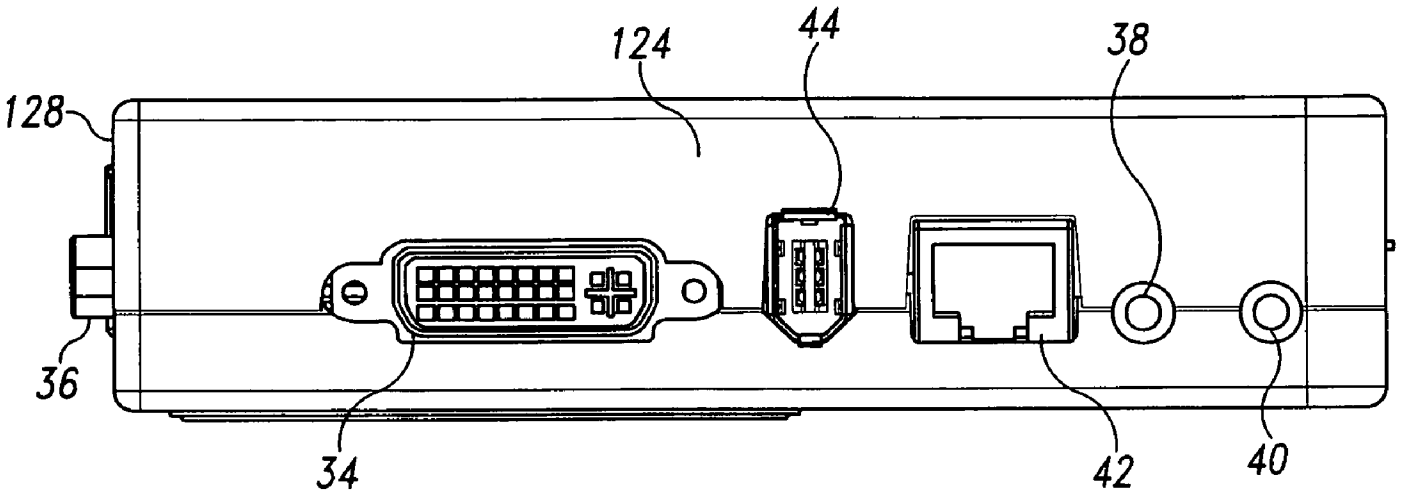
FIG. 4 is an elevation view of a side of the connector device depicted in FIG. 2.

Turning to FIGS. 3 and 4, a channel 136 is on the bottom 116 of the connector device 112 and extends from the notch 134 to the rear wall 120. The channel 136 provides for receiving, and thus passage of, a cable 138. In an embodiment, the cable 138 can be operatively connected to a laptop computer, in the space provided by notch 134, when the connector device 112 is attached to the computer. Accordingly, when the bottom 116 of the connector device 112 is placed on a planar surface such as that of a table, the channel 136 allows the cable 138 to pass essentially unimpeded under the connector device.

In an embodiment, but not necessarily, the cable 138 includes a connector in accordance with that disclosed in U.S. Patent Publication No. 2007/0072443, filed Sep. 26, 2005, and incorporated herein by reference. The connector can be for providing power to a portable computer or other device wherein the connector is held in place magnetically. As a result, if the cable 138 is tugged on, the connector will release from the computer without damaging the connector, the computer, or pulling the computer off a table, desk or the like.

As depicted in FIG. 3, provided on the forward portion 128 of the front 118 of the connector device 112 are the connectors for USB ports 48 and 50 and VGA port 36. Preferably, but not necessarily, USB ports 48,50 are provided by a stacked dual USB type-A connector.

Figure 5:
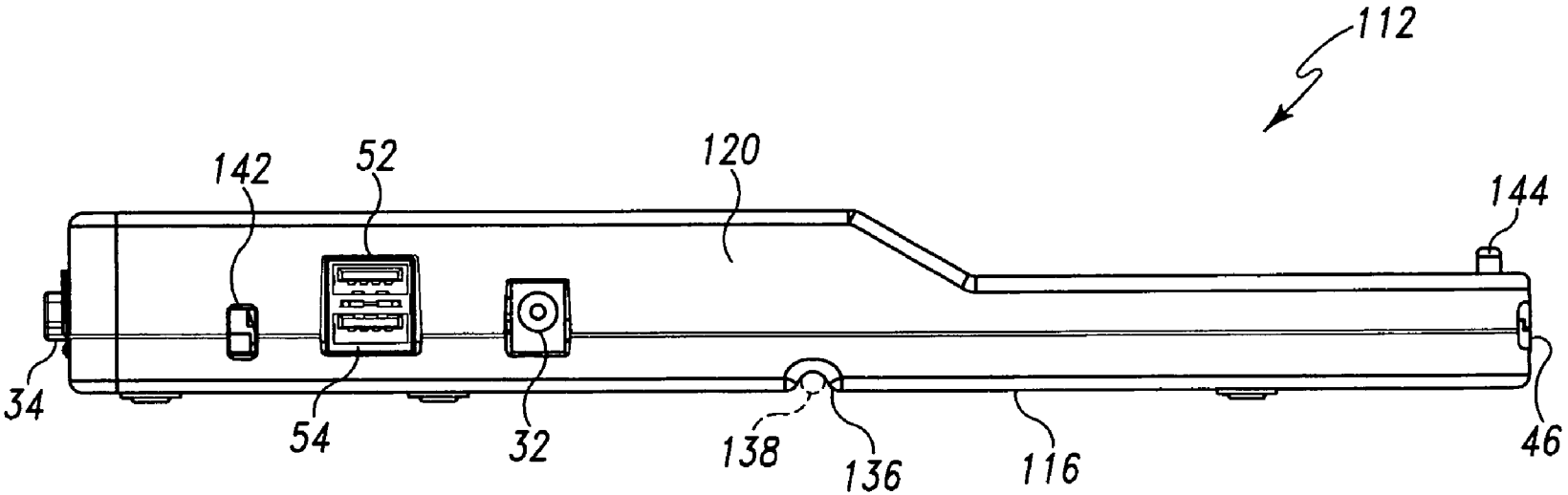
FIG. 5 is an elevation view of the other side of the connector device depicted in FIG. 2.

Similarly, as shown in FIG. 4, provided on the side wall 124 of the connector device 112 are the connectors for DVI port 34, FireWire port 44, Ethernet port 42 and Audio ports 38 and 40. Further, as illustrated in FIG. 5, provided on the rear wall 120 of the connector device 112 are the connectors for the USB hub power input 32 and USB ports 52 and 54 which are provided by a stacked dual USB type-A connector. Also, on the rear wall 120 of the connector device 112 is a slot 142 for attaching a lock (not shown).

Preferably, but not necessarily, the slot 142 is for attaching a lock from the Kensington Computer Products Group, Redwood Shores, Calif. The lock can be secured to the connector device 112 with a key and attached through a rubberized metal cable. The end of the cable can have a small loop for looping the cable around a permanent object such as the leg of a heavy table.

Figure 6:
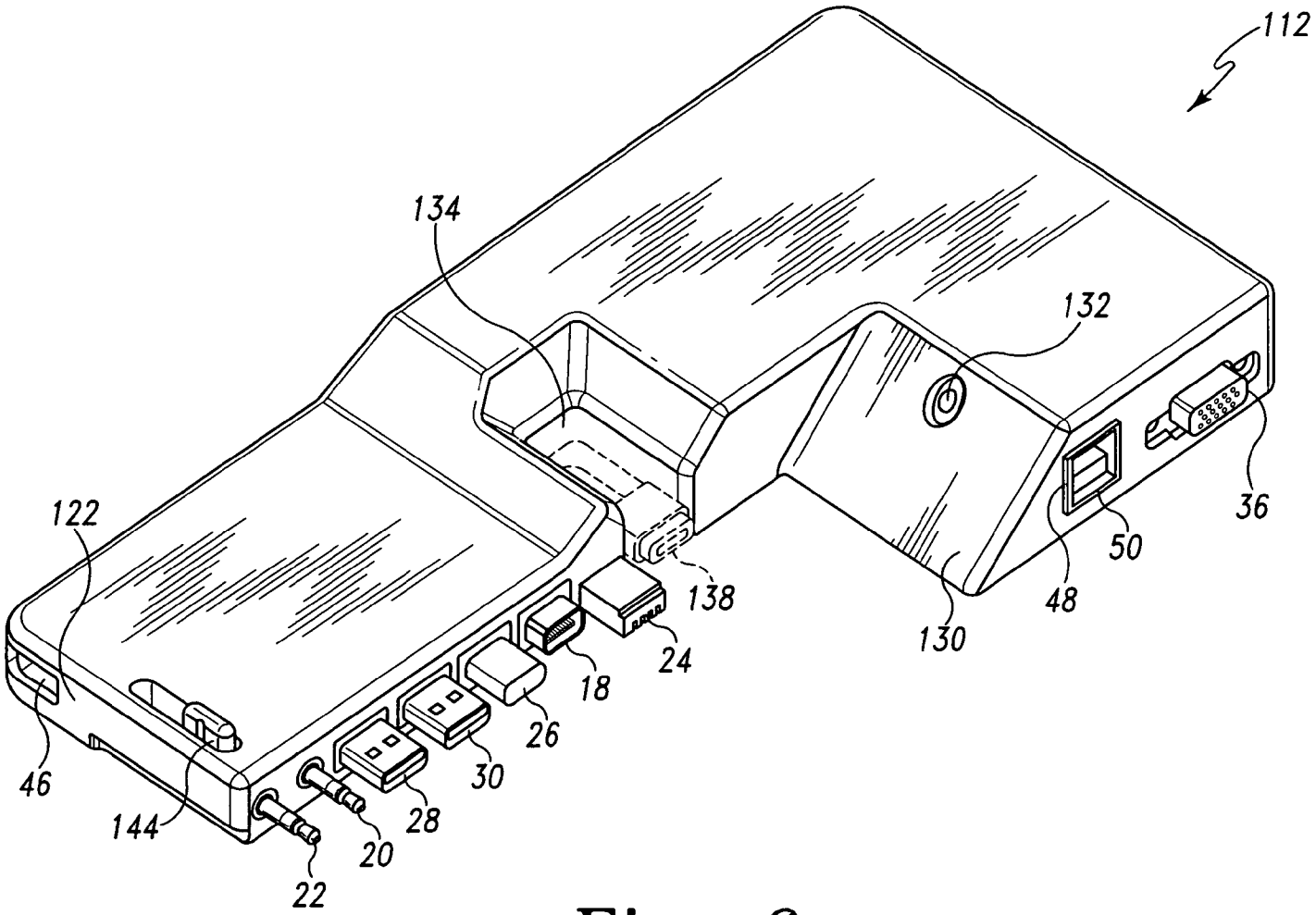
FIG. 6 is a perspective view of the connector device depicted in FIGS. 2-5; and, FIG. 7 is another perspective view of the connecter device depicted in FIGS. 2-6 wherein the connector device is coupled to a portable or laptop computer.
Figure 7:
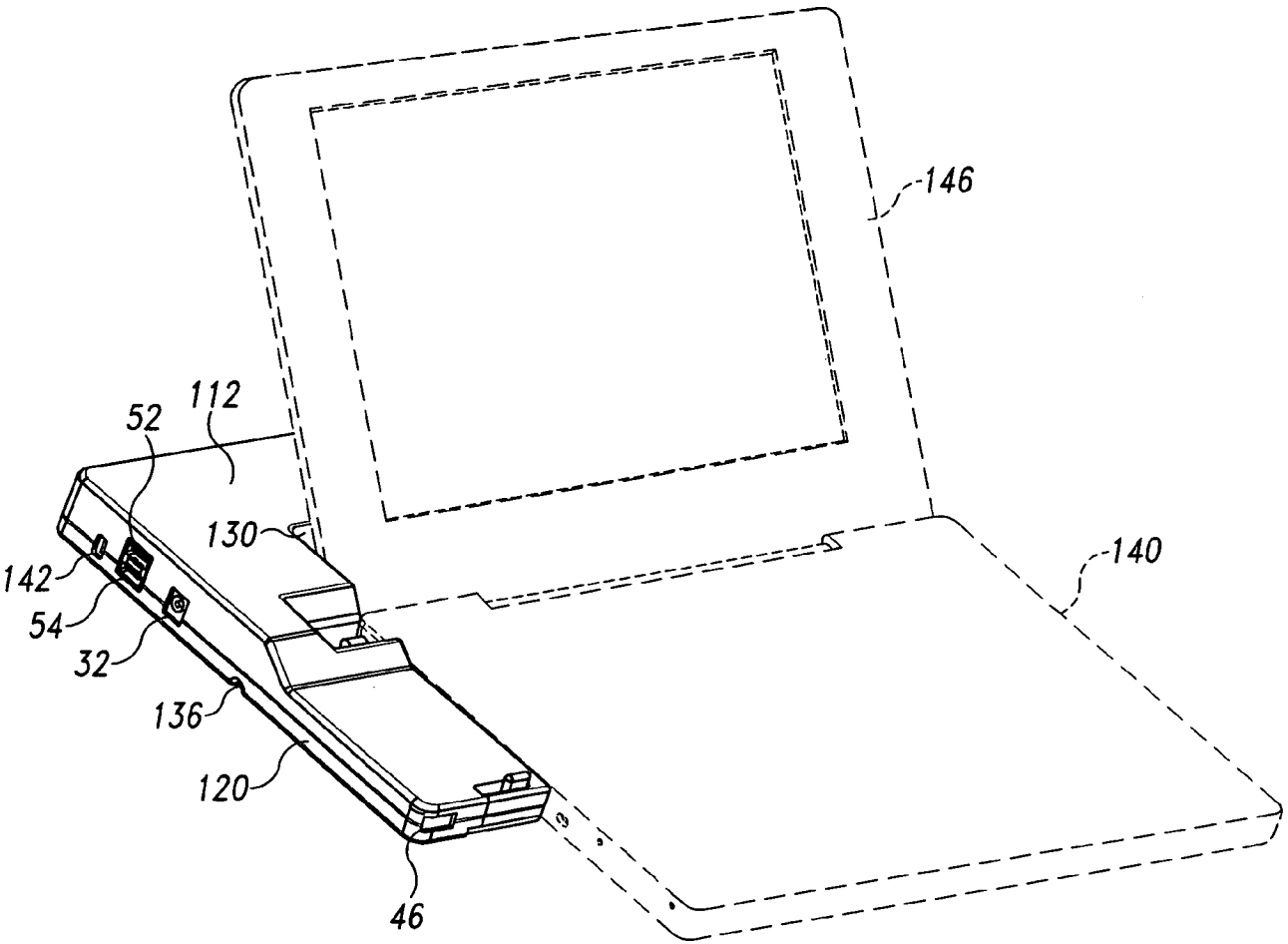

Turning to FIG. 6, on side wall 122 of the connector device 112 is a USB type-A connector for USB port 46. Also, above the side wall 122 of the connector device 112 is the lever 144 for moving audio connector 22 in and out of engagement with a port on the laptop computer 140 (FIG. 7). In an embodiment, when the connector device 112 is mounted to the laptop 140, the user can engage the audio connector 22 with the computer by sliding the lever 144 towards the computer. Conversely, the user can disengage the audio connector 22 by sliding the lever 144 away from the computer 140. Accordingly, as previously discussed above, the user can select, via lever 144, whether to use the internal speaker provided by the laptop or speakers external to the laptop.

Turning to FIG. 7, the connector device 112 is attached to the side of a portable computer 140. Preferably, when both the connector device 112 and the computer 140 are placed on a planar surface such as a tabletop, the connector device can be attached to the computer by first aligning the connectors on the connector device and the computer. Next, the bottom of the connector device 112 is slid towards the side of the computer until the two are coupled together. Likewise, to disconnect the connector device 112, it can be pulled away from the side of the computer 140.

As will be appreciated by those having ordinary skill in the art, when the connector device 112 is attached to the computer 140, the inclined wall 130 of the connector device can be adjoined by the top 146 of the computer 140 when the computer is opened.

It should be emphasized that the above-described embodiments of the present invention, particularly, any "preferred" embodiments, are possible examples of implementations merely set forth for a clear understanding of the principles for the invention. Many variations and modifications may be made to the above-described embodiment(s) of the invention without substantially departing from the spirit and principles of the invention. All such modifications are intended to be included herein within the scope of this disclosure and the present invention, and protected by the following claims.

What is claimed is:

1. A device comprising:

a generally L-shaped housing;

a plurality of input ports extending from the housing;

a plurality of output ports coupled to the housing wherein there are a greater number of output ports than input ports; and, wherein the housing includes a front pair of walls, a rear wall and a bottom with a notch in one of the front walls and a channel in the bottom extending from the notch to the rear wall.

2. A device comprising:

a generally L-shaped housing;

a plurality of input ports extending from the housing;

a plurality of output ports coupled to the housing wherein there are a greater number of output ports than input ports; and, wherein the housing includes a front pair of walls with an inclined portion perpendicularly extending between the front walls.

3. The device of claim 2 further comprising a light recessed within the inclined portion.

4. A device for coupling to connectors within a laptop computer, the device comprising:

a generally L-shaped housing having a pair of front walls, a rear wall, and a pair of side walls, one of the front walls being recessed from the other front wall;

a plurality of input connectors in the recessed front wall for coupling to the connectors within the laptop computer;

a plurality of output connectors in at least one of the side walls of the housing for transmitting and receiving electrical signals with the laptop computer; and, wherein at least one of the input connectors is an audio port that can be selectively engaged to the laptop when the device is coupled to the connectors of the laptop.

5. A device for coupling to connectors within a laptop computer, the device comprising:

a generally L-shaped housing having a pair of front walls, a rear wall, and a pair of side walls, one of the front walls being recessed from the other front wall;

a plurality of input connectors in the recessed front wall for coupling to the connectors within the laptop computer;

a plurality of output connectors in at least one of the side walls of the housing for transmitting and receiving electrical signals with the laptop computer; and, wherein the input connectors include at least one USB port and the output connectors include a greater number of USB ports.

6. A device for coupling to connectors within a laptop computer, the device comprising:

a generally L-shaped housing having a pair of front walls, a rear wall, and a pair of side walls, one of the front walls being recessed from the other front wall;

a plurality of input connectors in the recessed front wall for coupling to the connectors within the laptop computer;

a plurality of output connectors in at least one of the side walls of the housing for transmitting and receiving electrical signals with the laptop computer; and, wherein the housing includes a bottom with a notch in one of the front walls and the channel in the bottom extending from the notch to the rear wall.

7. A device for coupling to connectors within a laptop computer, the device comprising:

a generally L-shaped housing having a pair of front walls, a rear wall, and a pair of side walls, one of the front walls being recessed from the other front wall;

a plurality of input connectors in the recessed front wall for coupling to the connectors within the laptop computer;

a plurality of output connectors in at least one of the side walls of the housing for transmitting and receiving electrical signals with the laptop computer; and, wherein the housing includes an inclined wall perpendicularly extending from the recessed front wall.

8. The device of claim 7 further comprising a light recessed within the inclined wall.

9. A device for coupling to connectors within a laptop computer, the device comprising:

a generally L-shaped housing having a bottom wall, a pair of front walls, a rear wall, and a pair of side walls, one of the front walls being recessed from the other front wall with a notch formed therein and a channel in the bottom extending from the notch to the rear wall;

a plurality of input connectors in the in the recessed front wall for coupling to the connectors within the laptop computer;

a plurality of output connectors in at least one of the side walls of the housing for transmitting and receiving electrical signals with the laptop computer; and, wherein there are a greater number of output ports than input ports.

* * * * *